US011434044B2

(12) United States Patent
Downie

(10) Patent No.: US 11,434,044 B2
(45) Date of Patent: Sep. 6, 2022

(54) COLLAPSIBLE CONTAINER

(71) Applicant: Buku Engineering LLC, Albuquerque, NM (US)

(72) Inventor: Aaron S. Downie, Albuquerque, NM (US)

( * ) Notice: Subject to any disclaimer, the term of this patent is extended or adjusted under 35 U.S.C. 154(b) by 256 days.

(21) Appl. No.: 16/703,157

(22) Filed: Dec. 4, 2019

(65) Prior Publication Data

US 2021/0016923 A1 Jan. 21, 2021

Related U.S. Application Data

(60) Provisional application No. 62/875,191, filed on Jul. 17, 2019.

(51) Int. Cl.
*B65D 6/24* (2006.01)
*B65D 81/38* (2006.01)

(52) U.S. Cl.
CPC ..... *B65D 11/1893* (2013.01); *B65D 81/3813* (2013.01)

(58) Field of Classification Search
CPC ..... B65D 11/1893; B65D 11/1873; B65D 11/1866; B65D 81/3813; B65D 81/3823; B65D 2519/00925; B65D 7/28; B65D 9/18
USPC ..... 220/4.29, 669, 666, 4.31, 670–671, 6, 220/608, 7; 119/499
See application file for complete search history.

(56) References Cited

U.S. PATENT DOCUMENTS 3,966,072 A * 6/1976 Gonzales ..... B65D 19/12 220/7
4,735,331 A * 4/1988 Keenan ..... B65D 11/1833 220/6
5,562,224 A * 10/1996 Pascal ..... B65D 19/18 206/386
5,622,276 A 4/1997 Simmons
5,829,595 A * 11/1998 Brown ..... B65D 19/18 206/386
6,024,223 A * 2/2000 Ritter ..... B65D 19/18 206/386
6,041,958 A * 3/2000 Tremelo ..... B65D 81/3813 220/636

(Continued)

FOREIGN PATENT DOCUMENTS

DE 202011050812 U1 * 12/2011 ..... B65D 11/1826
ES 2350594 T3 * 1/2011 ..... B65D 11/1833

*Primary Examiner* — Chun Hoi Cheung
*Assistant Examiner* — Brijesh V. Patel
(74) *Attorney, Agent, or Firm* — Hovey Williams LLP

(57) ABSTRACT

A collapsible container, which can be used as a household storage container, a temperature containment vessel (i.e., "ice chest"), or other type of container. The collapsible container is shiftable between a collapsed configuration and an assembled configuration. The container base comprises opposed grooves, each comprising a pivot, wherein one pivot is farther from the interior surface of the base than the opposed pivot. A pair of side panels preferably comprise at least one arm member having an elongated guide formed therein that is rotationally and slidably engaged with respective base pivots to allow the panels to shift between an upright position a horizontal position, in a stacked configuration. The lid preferably comprises at least one passage formed horizontally in the top panel to allow air to flow therethrough.

18 Claims, 15 Drawing Sheets

(56) References Cited

U.S. PATENT DOCUMENTS

| | | | | |
|---|---|---|---|---|
| 6,098,803 | A * | 8/2000 | Tanaka | B65D 85/20 206/443 |
| 6,170,689 | B1 * | 1/2001 | Flesher | B65D 19/18 206/508 |
| 6,266,972 | B1 * | 7/2001 | Bostic | B65D 81/3823 62/530 |
| 6,598,756 | B1 * | 7/2003 | Rosenfeldt | B65D 19/16 217/15 |
| 7,028,504 | B2 * | 4/2006 | Derifield | B65D 81/3827 62/372 |
| 7,147,125 | B1 * | 12/2006 | Slovak | B65D 81/3818 220/592.2 |
| 7,156,249 | B2 * | 1/2007 | Heinrichs | B65D 11/1893 220/4.28 |
| 8,342,347 | B2 * | 1/2013 | Hay | B65D 11/1866 312/258 |
| 8,408,411 | B2 * | 4/2013 | Hay | B65D 19/18 220/666 |
| 8,770,421 | B2 * | 7/2014 | Hay | B65F 1/02 220/4.28 |
| 2004/0226309 | A1 * | 11/2004 | Broussard | F25D 11/003 62/236 |
| 2005/0230392 | A1 * | 10/2005 | Hadar | B65D 19/18 220/6 |
| 2006/0065655 | A1 | 3/2006 | Taylor | |
| 2007/0175236 | A1 * | 8/2007 | Dryzun | B65D 19/18 220/666 |
| 2008/0271402 | A1 * | 11/2008 | Gingras | E04B 1/34321 29/897.32 |
| 2009/0261111 | A1 | 10/2009 | Hsu | |
| 2013/0228583 | A1 * | 9/2013 | Mayer | B65D 81/3862 220/666 |
| 2015/0041420 | A1 * | 2/2015 | Zelek | A47F 5/10 211/195 |

* cited by examiner

COLLAPSIBLE CONTAINER

CROSS-REFERENCE TO RELATED APPLICATIONS

The present application claims the priority benefit of U.S. Provisional Application No. 62/875,191, filed Jul. 17, 2019, entitled COLLAPSIBLE TEMPERATURE CONTAINMENT VESSEL, incorporated by reference in its entirety herein.

BACKGROUND OF THE INVENTION

Field of the Invention

The present invention is generally directed to a collapsible container, and preferably a collapsible temperature containment vessel for keeping the contents within the vessel warm or cool.

Description of the Prior Art

Industry standard size "outfitters" ice chests operate similar to recreational ice chests but are generally larger, heavier, and made of stronger materials. These heavy-duty ice chests are typically bulkier in construction so as to withstand rougher handling and extreme weather conditions. They must also be large enough to carry large game or fish. However, the ice chests often take up substantial and valuable space in vehicles and boats, and specifically when in storage. Thus, there is a need for ice chests that are sufficiently durable for outfitters, while also requiring minimal transport and storage space when not in use.

Additionally, household containers, for example plastic storage and food containers, are generally manufactured with rigid construction and occupy significant cabinet and shelf space when not in use. Thus, there is a need for containers, and particularly household containers, that are capable of providing a rigid water and/or air-tight vessel when in use, while requiring minimal storage space when not in use.

SUMMARY OF THE INVENTION

In one or more embodiments, the present invention is directed to a collapsible container, shiftable between a collapsed configuration and an assembled configuration. The container comprises a base, a first side panel, a second side panel, a pair of removeable end panels, and a removeable lid. The base comprises an interior upper surface and a barrier wall extending vertically upward from the perimeter of the interior upper surface. The barrier wall comprises at least one first vertical groove formed on a first inward facing surface of the barrier wall and at least one second vertical groove formed on an opposed second inward facing surface of the barrier wall. The at least one first vertical groove comprises a first pivot, and the at least one second vertical groove comprises a second pivot. The first pivot is located at a position farther from the interior upper surface of the base than the second pivot. The first side panel comprises at least one first arm member having an elongated guide formed therein that is rotationally and slidably engaged with the first pivot to allow the first side panel to shift between an upright position when the container is in the assembled configuration and a horizontal position when the container is in the collapsed configuration. The second side panel comprises at least one second arm member rotationally engaged with the second pivot to allow the second side panel to shift between an upright position when the container is in the assembled configuration and a horizontal position between the interior upper surface of the base and the first side panel when the container is in the collapsed configuration. The pair of removeable end panels are adapted to be positioned upright and engage with the base, the first side panel, and the second side panel to define a container cavity when the container is in the assembled configuration and to be positioned horizontally adjacent the first side panel or the second side panel when the container is in the collapsed configuration. The removeable lid is adapted to engage with the first side panel, the second side panel, and the pair of removeable end panels when the container is in the assembled configuration and to engage with the barrier wall of the base when the container is in the collapsed configuration.

In another embodiment, there is provided a temperature containment vessel comprising a base, a pair of side panels, a pair of end panels, and a removeable lid adapted to engage with the pair of side panels and the pair of end panels. The removeable lid comprises a top panel and a lid barrier wall extending vertically downward from the perimeter of the top panel. The lid further comprises at least one passage formed horizontally in the top panel and adapted to allow air to flow therethrough.

In yet another embodiment, there is provided a collapsible container shiftable between a collapsed configuration and an assembled configuration. The container comprises a base, a first side panel, a second side panel, a pair of removeable end panels, and a removeable lid. The base comprises an interior upper surface and a barrier wall extending vertically upward from the perimeter of the interior upper surface and defining a base cavity. The barrier wall comprises at least one first vertical groove formed on a first inward facing surface of the barrier wall and at least one second vertical groove formed on an opposed second inward facing surface of the barrier wall. The at least one first vertical groove comprises a first pivot, and the at least one second vertical groove comprises a second pivot. The first pivot is located at a position farther from the interior upper surface of the base than the second pivot. The first side panel comprises at least one first arm member having an elongated guide formed therein that is rotationally and slidably engaged with the first pivot to allow the first side panel to shift between an upright position when the container is in the assembled configuration and a horizontal position when the container is in the collapsed configuration. The second side panel comprises at least one second arm member having an elongated guide formed therein that is rotationally and slidably engaged with the second pivot to allow the second side panel to shift between an upright position when the container is in the assembled configuration and a horizontal position between the interior upper surface of the base and the first side panel when the container is in the collapsed configuration. The first side panel and the second side panel are of substantially identical construction and are adapted to reside within the base cavity when the container is in the collapsed configuration. The pair of removeable end panels has substantially identical construction and are adapted to be positioned upright and engage with the base, the first side panel, and the second side panel to define a container cavity when the container is in the assembled configuration and to be positioned horizontally adjacent the first side panel or the second side panel when the container is in the collapsed configuration. The removeable lid is adapted to engage with the first side panel, the second side panel, and the pair of removeable end panels when the container is in the assembled configuration and to engage with the barrier wall of the base when the container is in the collapsed configuration.

DETAILED DESCRIPTION OF THE PREFERRED EMBODIMENT

Figure 1:
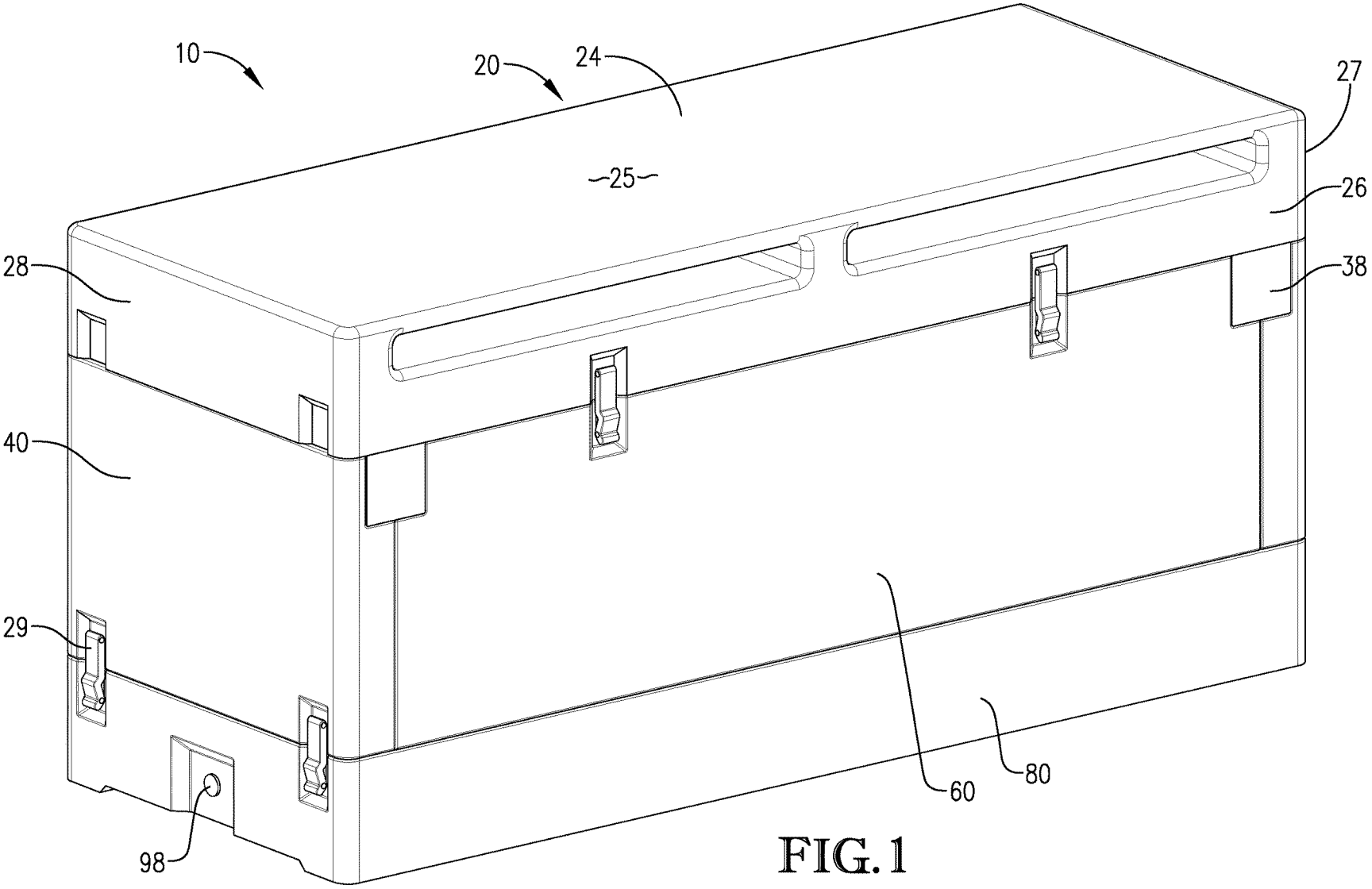
FIG. 1 is a perspective view of a collapsible container in the assembled configuration in accordance with one embodiment of the present invention.
Figure 2:
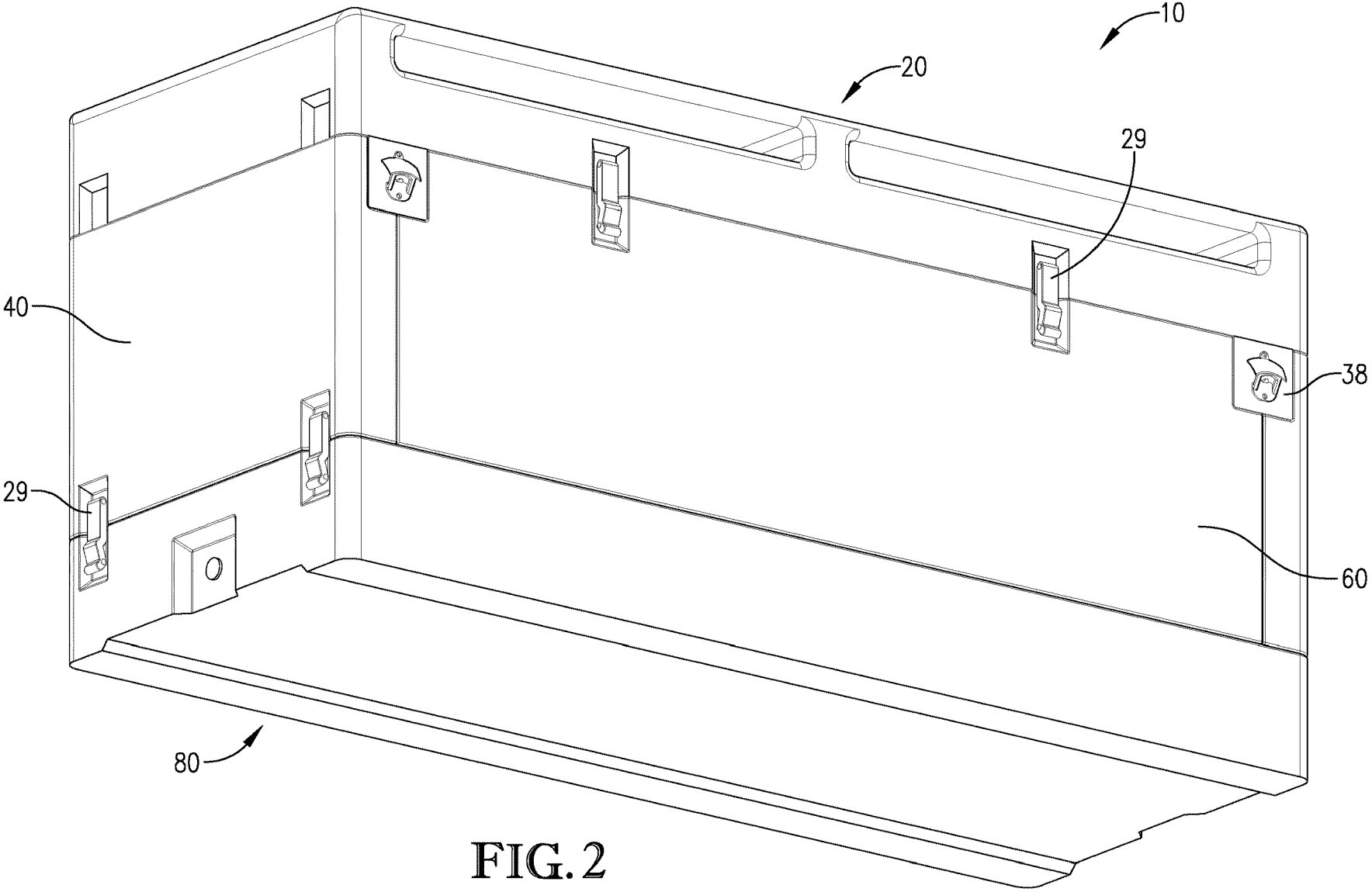
FIG. 2 is a perspective view from another angle of the collapsible container of FIG. 1.
Figure 3:
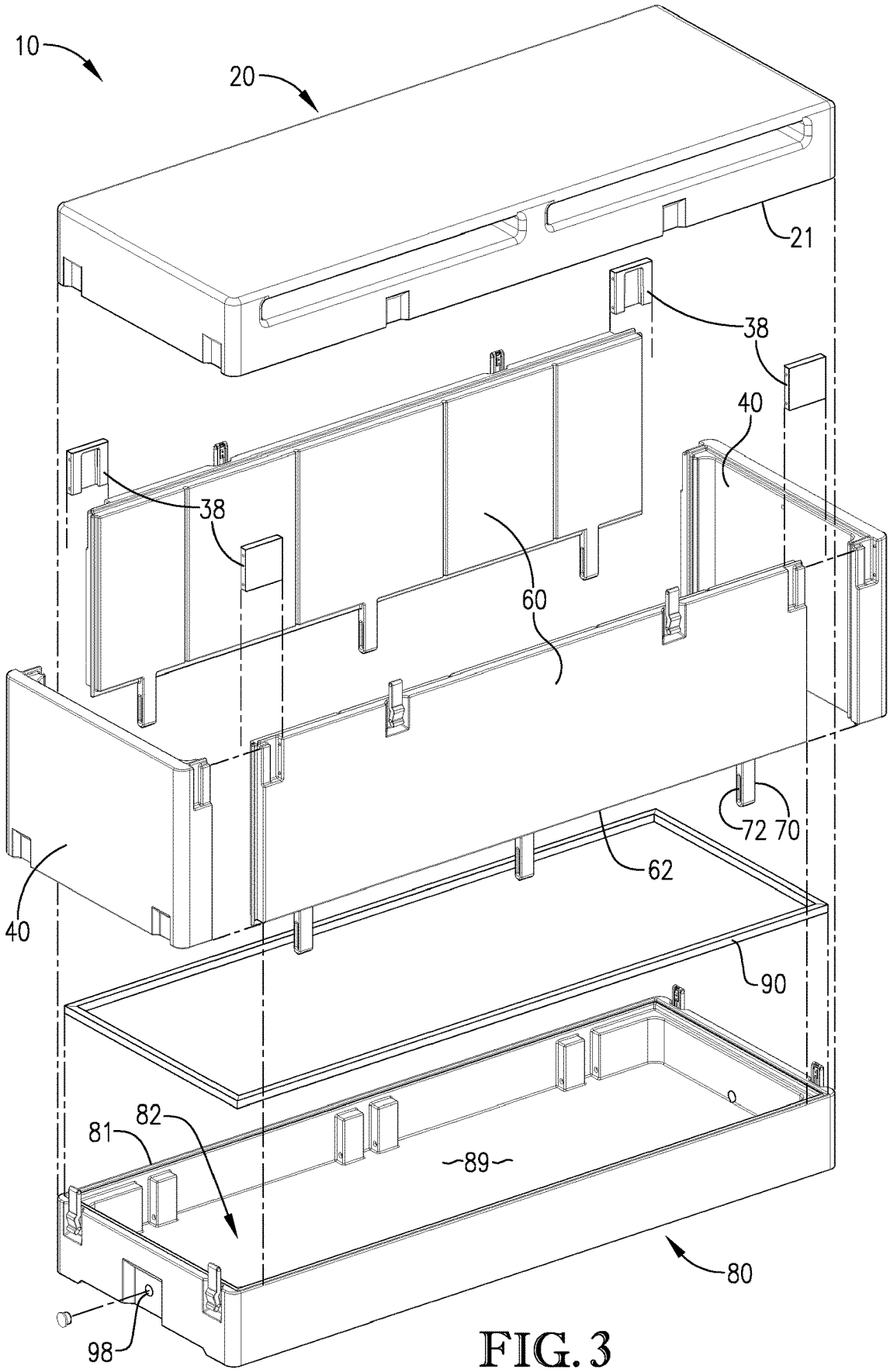
FIG. 3 is an exploded perspective view of the collapsible container of FIG. 1.
Figure 4:
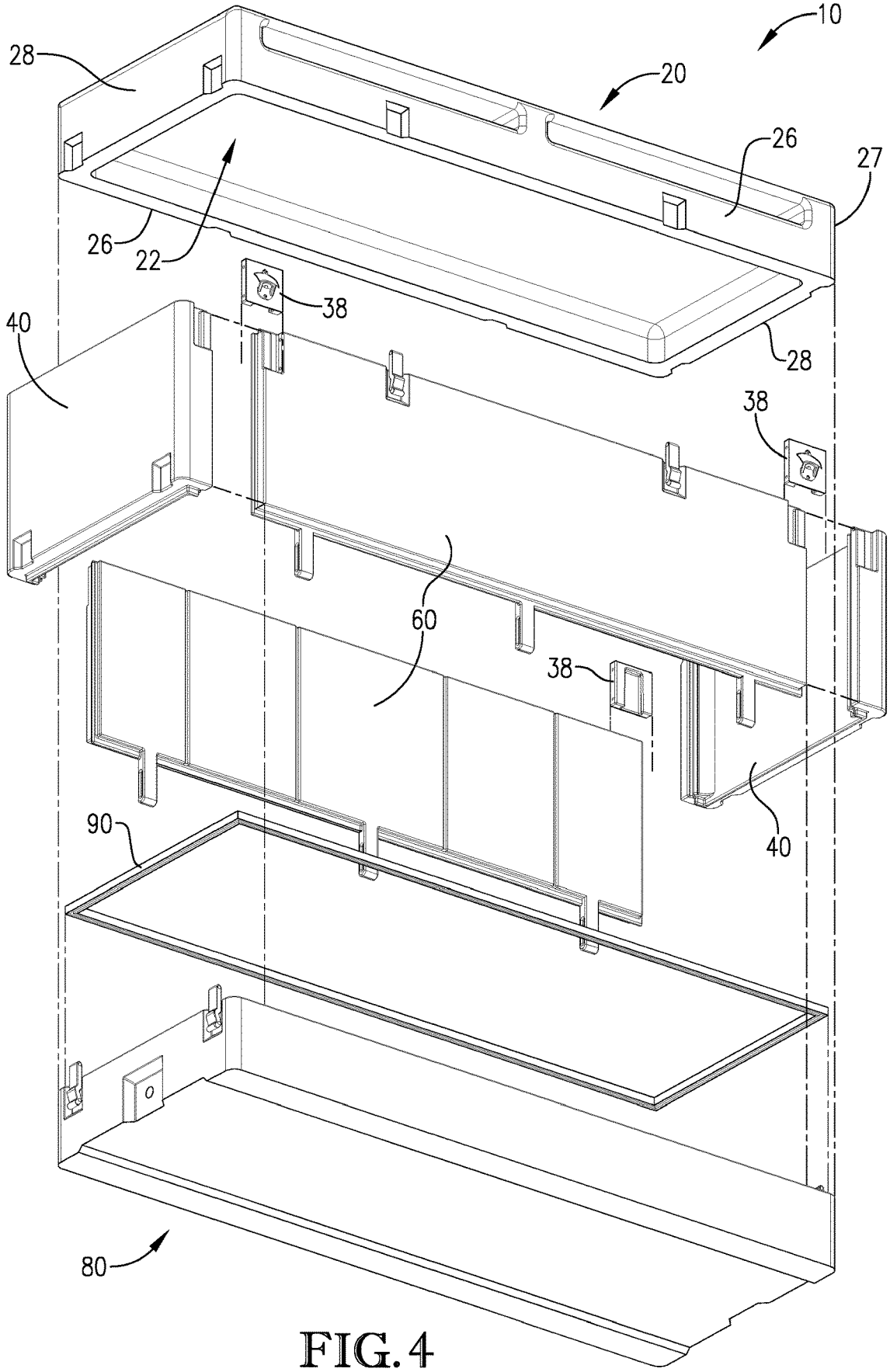
FIG. 4 is an exploded perspective view from another angle of the collapsible container of FIG. 1.
Figure 5:
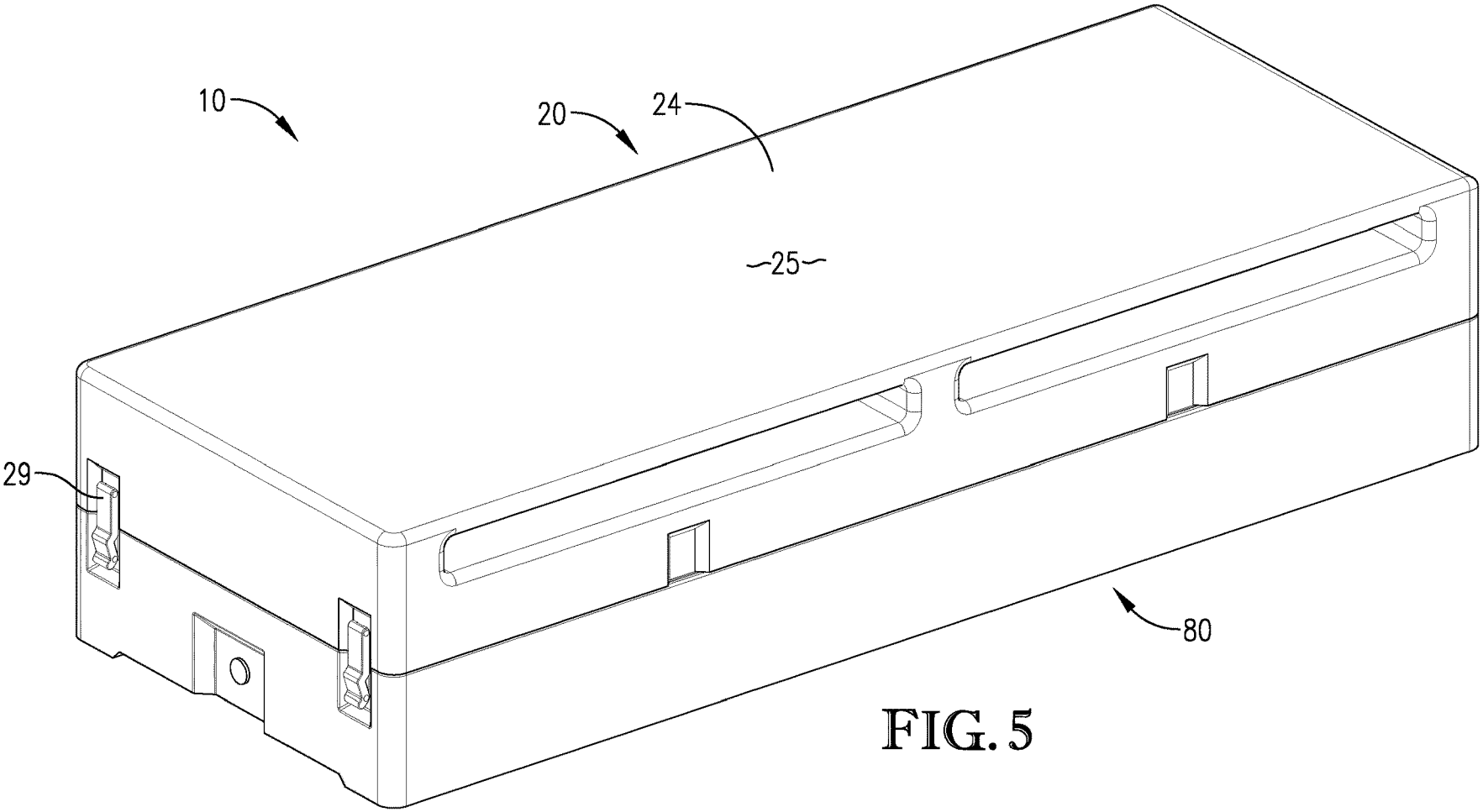
FIG. 5 is a perspective view of a collapsible container in the collapsed configuration in accordance with one embodiment of the present invention.

Embodiments of the present invention are generally directed to a collapsible container shiftable between a collapsed configuration and an assembled configuration. FIG. 1 and FIG. 2 show container 10 in the assembled configuration, comprising base 80, removeable lid 20, end panels 40, and side panels 60. End panels 40 and side panels 60 are interlocked with each other and with base 80 and lid 20 to provide a water-proof, and preferably air-tight, sealed enclosure as described in more detail herein. FIG. 3 and FIG. 4 show an exploded view of the components of container 10 in the assembled configuration. FIG. 5 shows container 10 in the collapsed configuration, generally comprising lid 20 and base 80 with end panels 40 and side panels 60 contained therein and unseen. In the collapsed configuration, container 10 has decreased storage volume as compared to the upright assembled configuration. However, even in the collapsed configuration, container 10 must have sufficient volume to store end panels 40 and side panels 60 between lid 20 and base 80. Details of lid 20, end panels 40, side panels 60, base 80, and other components, as well as assembly of container 10 from the collapsed configuration to the upright assembled configuration, are described in greater detail below.

As best shown in FIG. 1 and FIG. 5, lid 20 is adapted to engage with side panels 60 and end panels 40 when the container is in the assembled configuration (FIG. 1), and to engage with base 80 when the container is in the collapsed configuration (FIG. 5). Lid 20 generally comprises top panel 24 having an exterior upper surface 25. Lid 20 further comprises lid barrier wall 27, which is formed by a pair of opposed sidewalls 26 and a pair of opposed endwalls 28 extending vertically downward from the perimeter of top panel 24 to perimeter edge 21. Sidewalls 26 and endwalls 28 of barrier wall 27 define a lid cavity 22, the volume of which is defined by the length and height of sidewalls 26 and endwalls 28. In certain embodiments, sidewalls 26 and endwalls 28 comprise a single, unitary structure so as to form a continuous perimeter extending from top panel 24 of lid 20.

Figure 6:
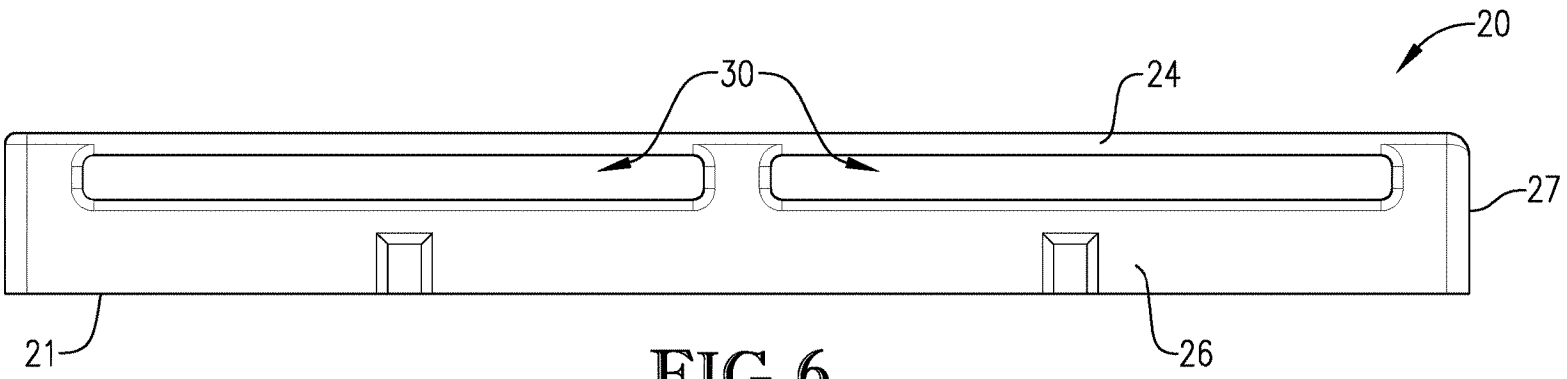
FIG. 6 is a side view of a lid in accordance with one embodiment of the present invention.

In certain embodiments, and particularly when container 10 is an ice chest, lid 20 further comprises a built-in solar shield on top panel 24. The solar shield uses a heat transfer mechanism, or combination of heat transfer mechanisms, to minimize solar heat transfer into storage cavity 36 of container 10. A first mechanism is to manufacture upper surface 25 of top panel 24 to comprise a light color (preferably white), for example by painting. Using a white or other light color on surface 25 reflects the majority (preferably at least about 70%) of the solar heat radiation contacting surface 25. A second mechanism is the use of a thermal air gap barrier comprising at least one passage 30 formed horizontally in lid 20 and adapted to allow air to flow therethrough. As shown in FIG. 6, the thermal air gap comprises as a pair of passages 30 formed through sidewalls 26 of lid 20 and positioned between top panel 24 and lid barrier wall 27, such that the passages 30 reside above lid cavity 22. Although the embodiment shown comprises a pair of passages 30, it should be understood that lid 20 may comprise one passage, two passages, or a plurality of passages, and the passages may pass horizontally in various directions through sidewalls 26 or endwalls 28. Regardless the embodiment, passages 30 should provide an air gap through which natural or artificial airflow can pass through lid 20 beneath exterior upper surface 25 and above lid cavity 22. The airflow causes convective heat transfer, which directs solar heat absorbed by top panel 24 to be carried away from lid 20. This further reduces the amount of solar heat transferred through lid 20 into lid cavity 22 and ultimately into storage cavity 36.

Lid 20 is removable from container 10, both when container 10 is in the collapsed configuration and when container 10 is in the assembled configuration. Lid 20 is adapted to engage with, and preferably be in contact with, base 80 when container 10 is in the collapsed configuration. In certain embodiments, lower perimeter edge 21 of lid 20 has substantially similar dimensions as upper perimeter edge 81 of base 80, such that lower perimeter edge 21 and upper perimeter edge 81 are in contact when container 10 is in the collapsed configuration. Lower perimeter edge 21 and/or upper perimeter edge 81 may further comprise a seal 90 (e.g., rubber or plastic gasket) so as to provide water-proof storage of the end panels 40 and side panels 60, even when container 10 is in the collapsed configuration. In certain embodiments, lid 20 and base 80 comprise one or more fastening mechanisms 29 to secure lid 20 to base 80 and to prevent lid 20 from becoming dislodged during movement and storage of container 10. Any of a variety of fastening mechanisms may be used, such as toggle latches, hook latches, hasps, and the like. The type of fastening mechanism and the number of fasteners used can be selected as needed or desired based on the size of the container and its specific use.

Figure 7:
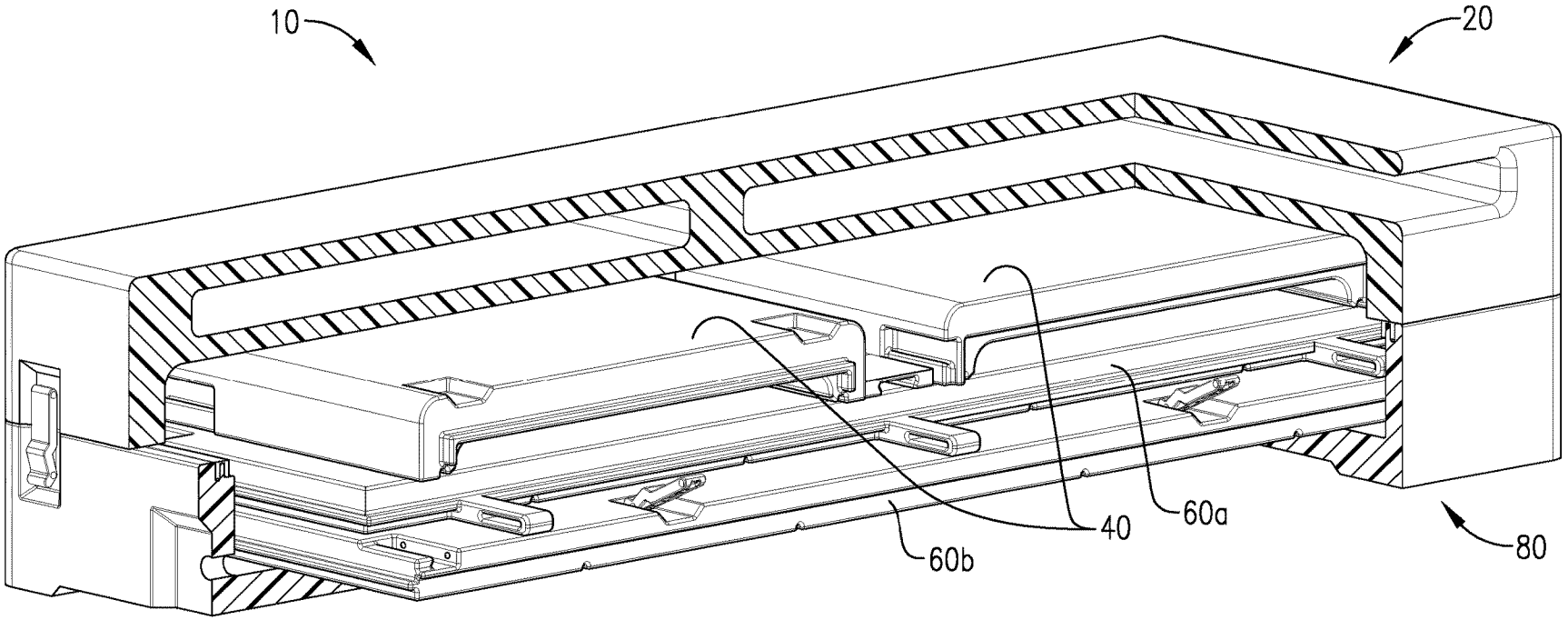
FIG. 7 is a cutaway view of the collapsible container of FIG. 5.

As shown in FIG. 7, in the collapsed configuration, end panels 40 are arranged horizontally side-by-side and positioned in a stacked arrangement on top of side panels 60. In the embodiment shown, end panels 40 are positioned adjacent first side panel 60*a*. In other embodiments, however, end panels 40 may be positioned between first side panel 60*a* and second side panel 60*b* or below second side panel 60*b* adjacent base 80. Side panels 60 reside within base cavity 82 of base 80, arranged with first side panel 60*a* stacked on top of second side panel 60*b*. In the collapsed configuration, side panels 60 are arranged in a horizontal position adjacent base 80 and substantially parallel to interior upper surface 89 of base 80, with second side panel 60*b* positioned between first side panel 60*a* and interior upper surface 89 of base 80. The arrangement of side panels 60*a*, 60*b* are described in greater detail below.

Figure 8:
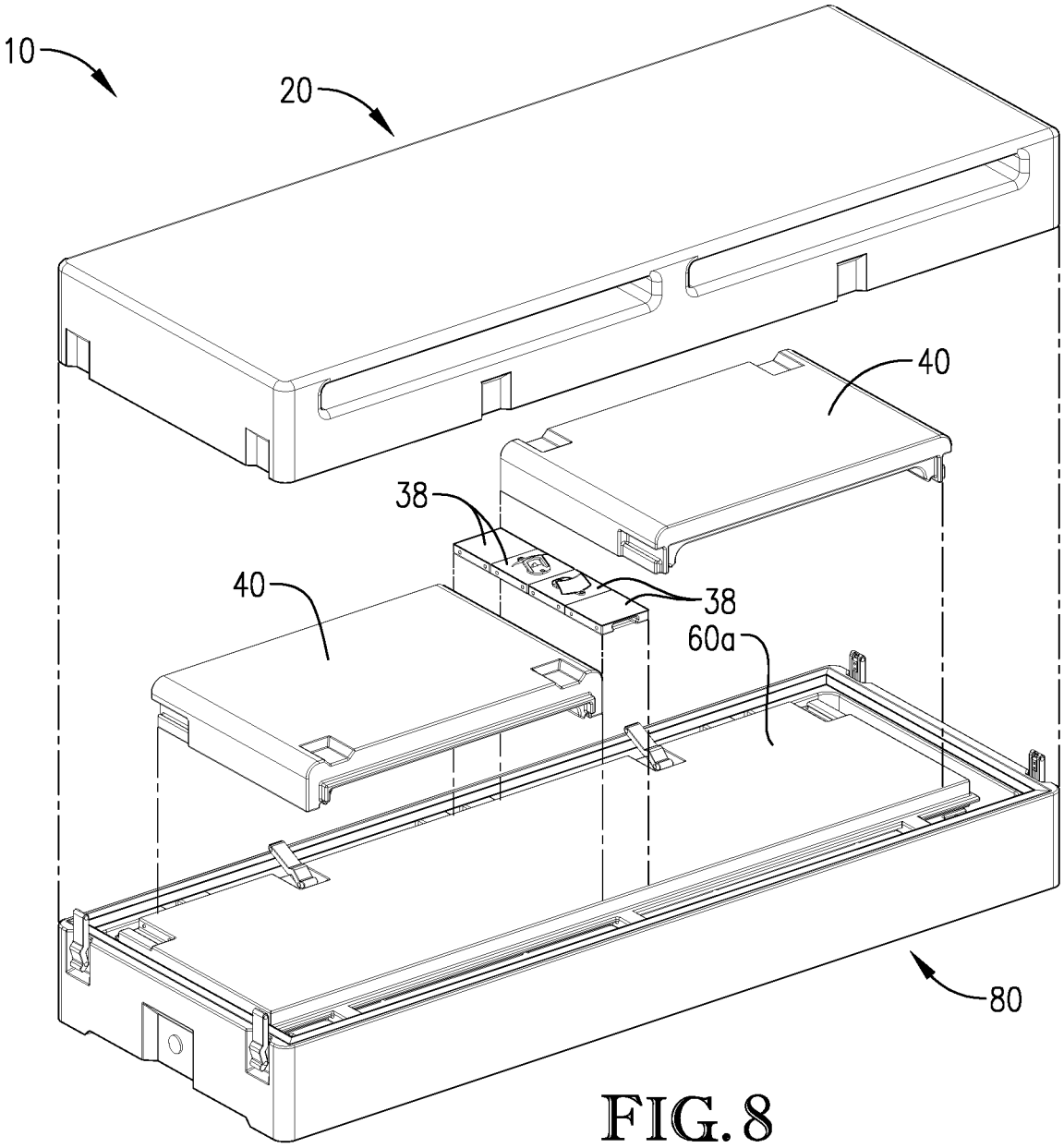
FIG. 8 is a perspective view of a collapsible container of FIG. 5 with the lid, end panels, and locking mechanisms removed from the base.

To begin assembly of container 10, lid 20 is removed and separated from base 80. FIG. 8 shows container 10 in the collapsed configuration with lid 20 removed from base 80, thereby revealing end panels 40 and side panels 60 stored within container 10, with first side panel 60*a* stacked on top of second side panel 60*b*.

Figure 9:
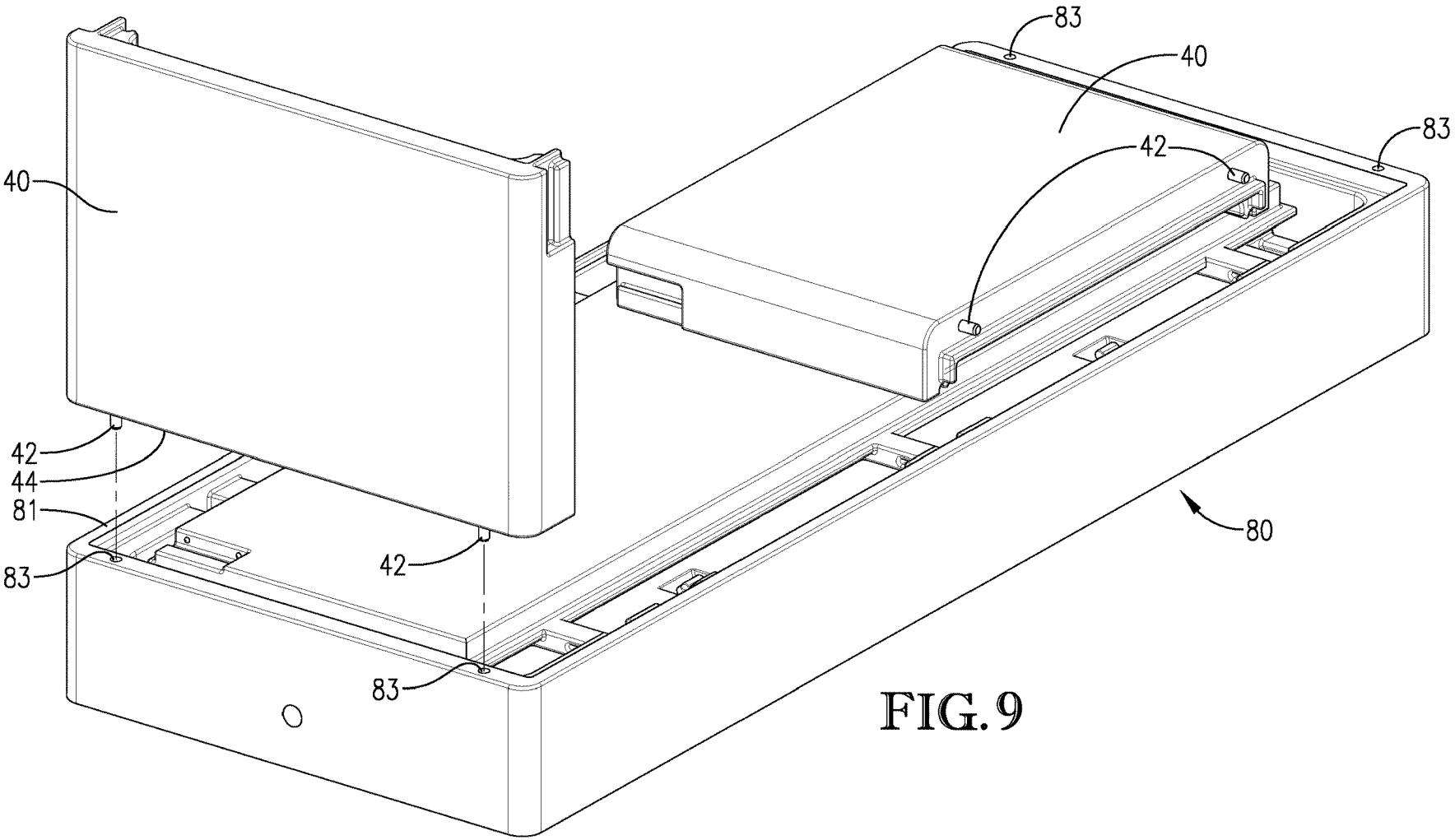
FIG. 9 is a perspective view of a collapsible container during end panel installation in accordance with one embodiment of the present invention.

With lid 20 removed, end panels 40 can be installed on base 80 as shown in FIG. 9. End panels 40 are adapted to be positioned upright and engage with perimeter edge 81 of base 80 when container 10 is in the assembled configuration. In the embodiment shown in FIG. 9, end panels 40 comprise one or more studs 42 projecting from bottom edge 44 of end panels 40. Studs 42 are adapted to fit into respective holes 83 formed in perimeter edge 81 of base 80 to hold panels 40 in place during and after assembly of container 10. Other mechanisms may also be used in addition to or in place of studs 42, so long as end panels 40 are secured generally upright during and after assembly of container 10. In certain embodiments, end panels 40 may comprise a tongue positioned along bottom edge 44 and adapted to fit in groove 84 of base 80. The tongue-and-groove fit further secures end panels 40 to base 80. A seal 90 (e.g., rubber or plastic gasket) may be included on one or both of the tongue and groove to provide a waterproof seal, and preferably air-tight seal, between the mated components. As described below, the same or similar waterproof seal may be included between some or all mated panels and components of container 10 to render cavity 36 substantially or completely water-impermeable, and preferably air-tight, when container 10 is in the assembled configuration. In certain preferred embodiments, end panels 40 comprise a pair of two substantially identical panels (i.e., of substantially identical or entirely identical construction). This advantageously simplifies assembly of container 10, since either panel can be installed on either end of base 80. Additionally, this reduces the number of separate components required to be manufactured, thereby reducing costs associated with manufacturing dies and replacing damaged panels.

Side panels 60 can be installed, either before or after end panels 40 have been installed. Side panels 60 are generally secured to base 80 when container 10 is both in the collapsed configuration and in the assembled configuration, such that side panels 60 and base 80 are in continuous contact during assembly and collapsing of container 10. Advantageously, it is unnecessary to separate side panels from base 80 during assembly of container 10, which simplifies installation and reduces the risk of losing or damaging parts. However, in certain embodiments, side panels 60 can be separated from base 80, for example to replace damaged panels 60 or base 80, or to allow for customization or further processing of individual components. Side panels 60 generally comprise at least one arm member 70 extending from bottom edge 62 of side panels 60. In the embodiment shown, arm member 70 comprises an elongated guide 72 formed therein. Arm member 70 is adapted to engage with base 80 to shift container 10 between the assembled configuration and the collapsed configuration without separating side panels 60 from base 80. Similar to end panels 40, in certain preferred embodiments, side panels 60 comprise a pair of two substantially identical panels (i.e., of substantially identical or entirely identical construction). This advantageously simplifies assembly of container 10 and reduces the number of separate components required to be manufactured. As described below, the design of base 80 enables the pair of side panels 60 to be of substantially identical (or completely identical) construction yet still be organized into the stacked arrangement shown in FIG. 7 when container 10 is in the collapsed configuration.

Figure 10:
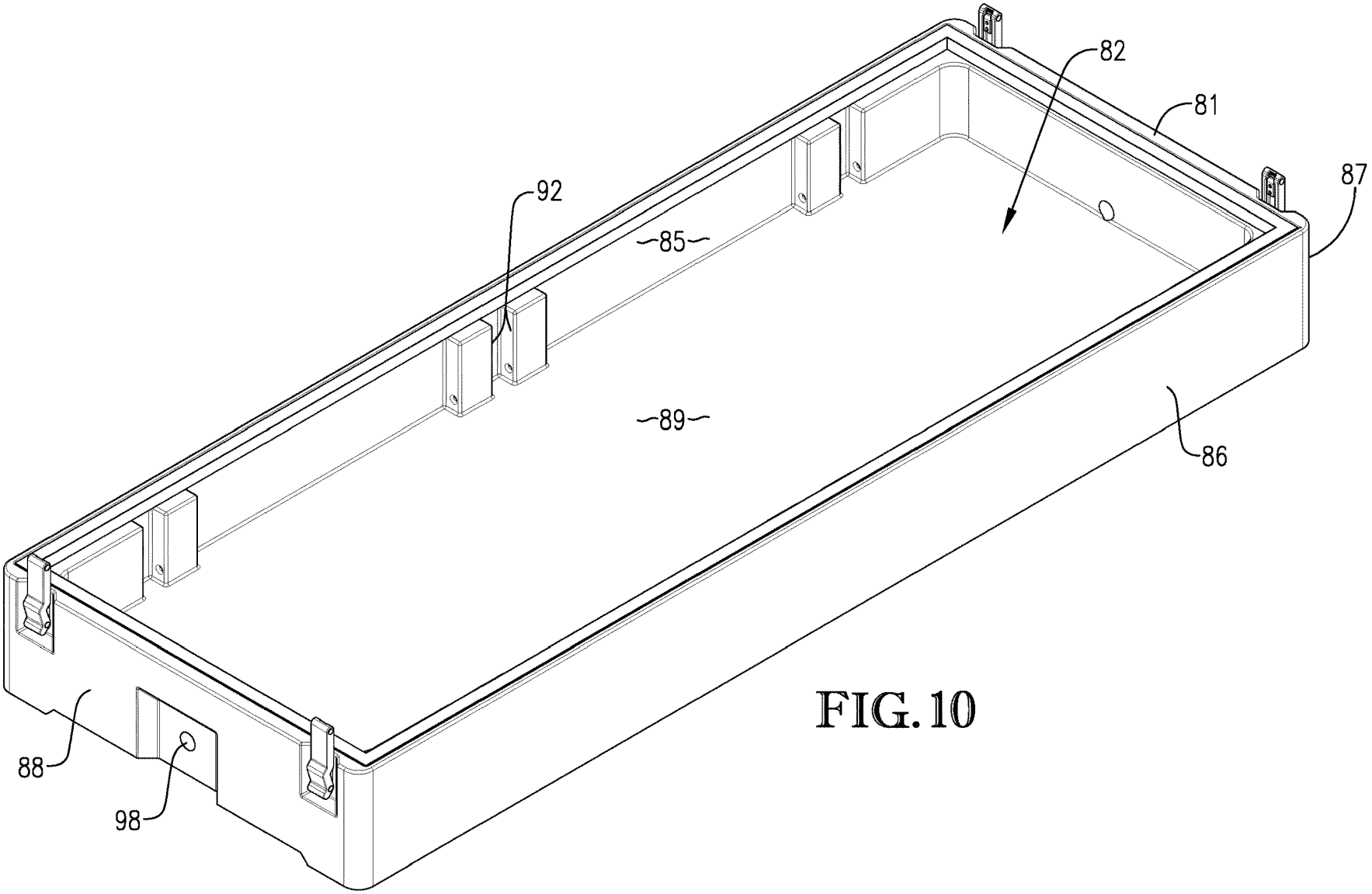
FIG. 10 is a perspective view of a base in accordance with one embodiment of the present invention.

As best shown in FIG. 10, base 80 generally comprises interior upper surface 89 and base barrier wall 87. Base barrier wall 87 is formed by a pair of opposed sidewalls 86 and a pair of opposed endwalls 88 extending vertically upward from the perimeter of the interior upper surface 89 toward a perimeter edge 81. Sidewalls 86 and endwalls 88 of barrier wall 87 define a base cavity 82, the volume of which is defined by the length and height of sidewalls 86 and endwalls 88. In preferred embodiments, base cavity 82 should be sized such that side panels 60 reside within base cavity 82 when container 10 is in the collapsed configuration. In certain embodiments, sidewalls 86 and endwalls 88 comprise a single, unitary structure so as to form a continuous perimeter extending from upper surface 89 of base 80. One or more drains 98 may be formed in sidewalls 86 and/or endwalls 88 of barrier wall 87.

Figure 11:
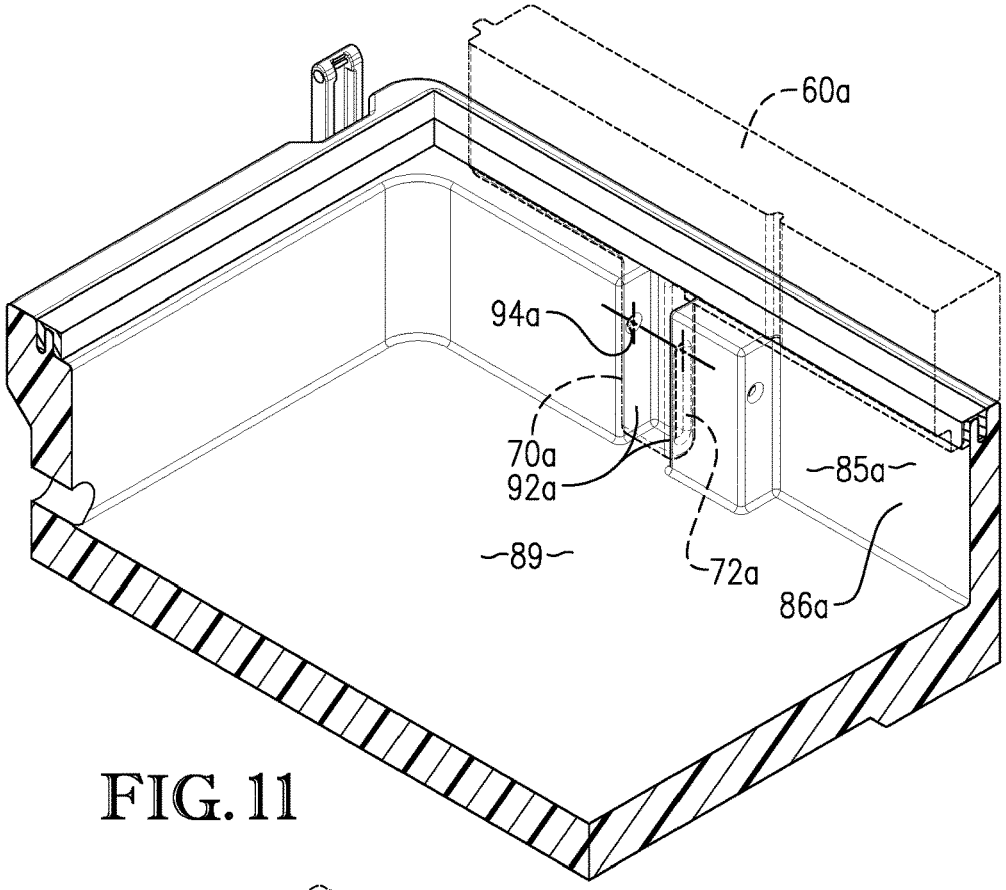
FIG. 11 is a cutaway view of a base showing one groove and pivot location in accordance with one embodiment of the present invention.
Figure 12:
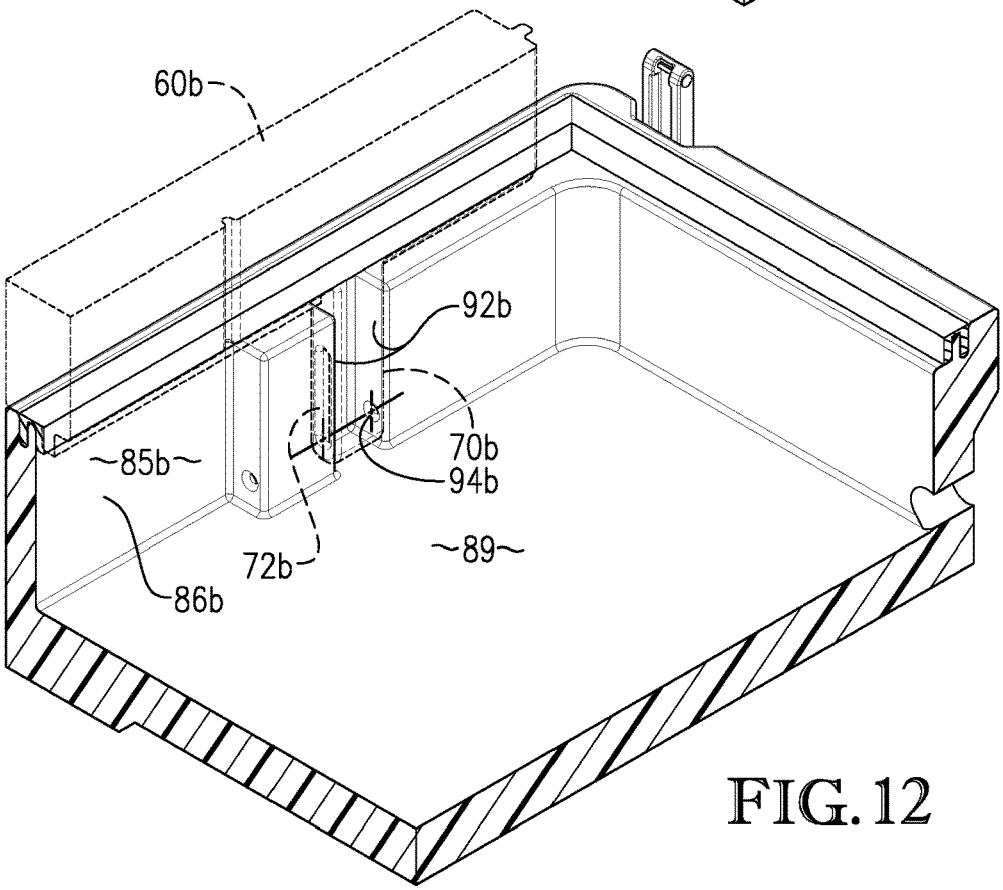
FIG. 12 is a cutaway view of a base showing another groove and pivot location in accordance with one embodiment of the present invention.

Barrier wall 87 comprises at least one vertical groove 92 formed on inward facing surface 85 of base barrier wall 87 and at least one vertical groove 92 formed on an opposed side of inward facing surface 85. In the embodiment shown, at least one first vertical groove 92*a* is formed on a first inward facing surface 85*a* of sidewall 86*a*, and at least one second vertical groove 92*b* is formed on a second inward facing surface 85*b* of sidewall 86*b* (see FIGS. 11 and 12). Each vertical groove 92 comprises a pivot 94 adapted to engage with a respective arm member 70 of side panels 60. Pivot 94 may be any of a number of projections, pins, shafts, and the like, either formed into vertical groove 92 or separately installed, so long as arm member 70 is capable of rotating about the desired point of pivot 94.

First vertical groove 92*a* comprises first pivot 94*a* and second vertical groove 92*b* comprises second pivot 94*b*. First pivot 94*a* is located at a position farther from interior upper surface 89 of base 80 than second pivot 94*b*. First arm member 70*a* of first side panel 60*a* has an elongated guide 72*a* formed therein that is both rotationally and slidably engaged with first pivot 94*a* to allow first side panel 60*a* to shift between an upright position when container 10 is in the assembled configuration and a horizontal position adjacent second side panel 60*b* when container 10 is in the collapsed configuration. Second arm member 70*b* of second side panel 60*b* is rotationally engaged with second pivot 94*b* to allow second side panel 60*b* to shift between an upright position when container 10 is in the assembled configuration and a horizontal position adjacent first side panel 60*b* when container 10 is in the collapsed configuration. When side panels 60 are substantially or entirely identical, such as in the embodiment shown, second arm member 70*b* may have elongated guide 72*b* formed therein that is rotationally and slidably engaged with second pivot 94*b*. However, in certain embodiments, second arm member 70*b* does not need to be slidable about second pivot 94*b*, and thus side panel 60*b* may comprise a second arm member 70*b* having any of a variety of other mechanisms other than an elongated guide, so long as second arm member 70*b* is at least rotatable about second pivot 94*b*.

Figure 13:
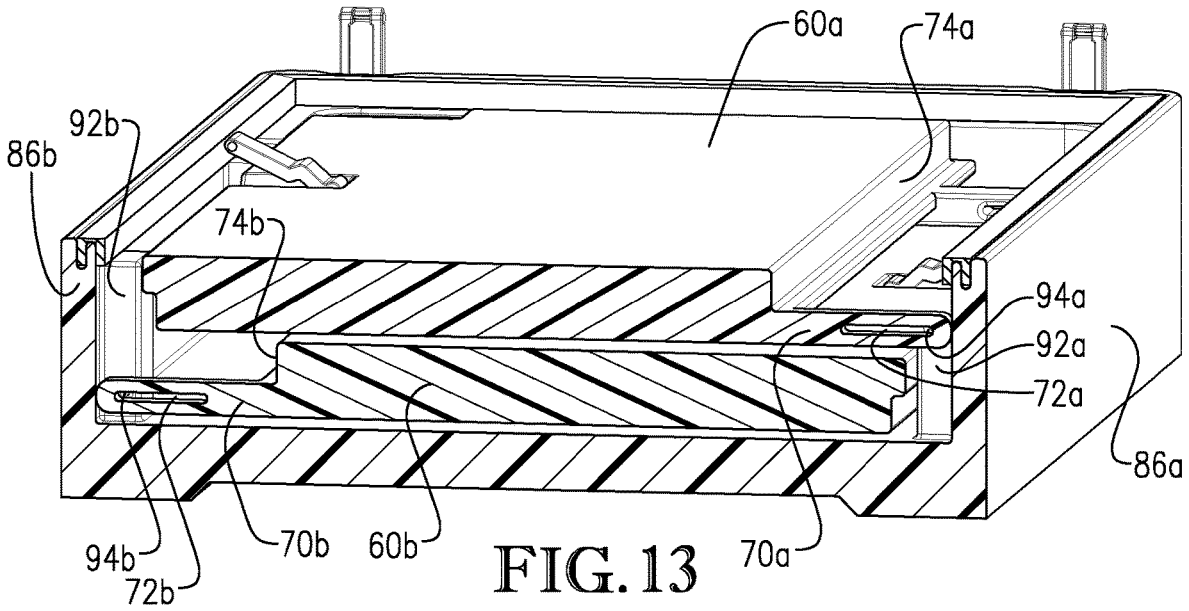
FIG. 13 is a cross-section of a base and side panels in the collapsed configuration in accordance with one embodiment of the present invention.
Figure 14:
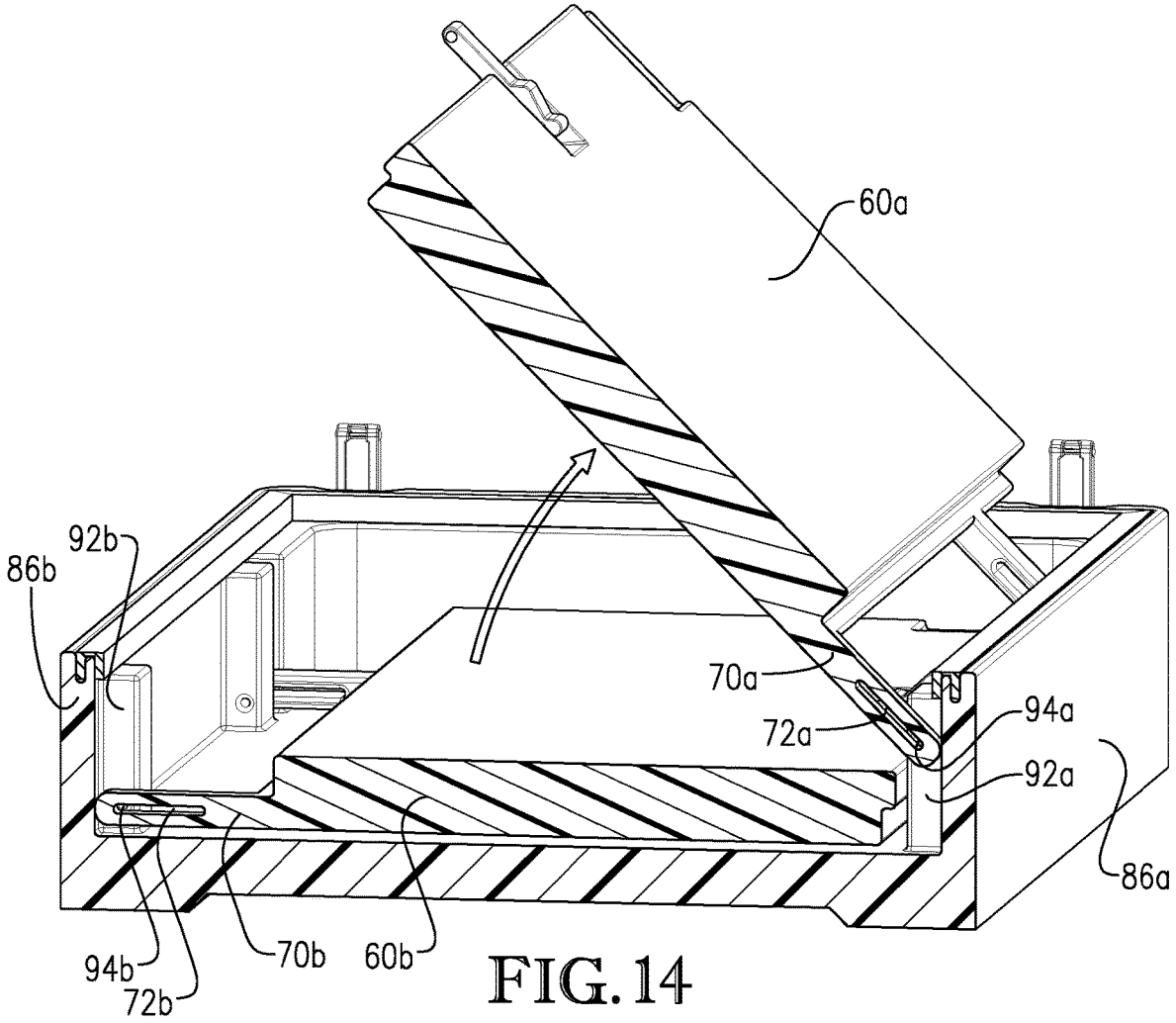
FIG. 14 is a cross-section of the base and side panels of FIG. 13 during assembly of the container from the collapsed configuration to the assembled configuration.
Figure 15:
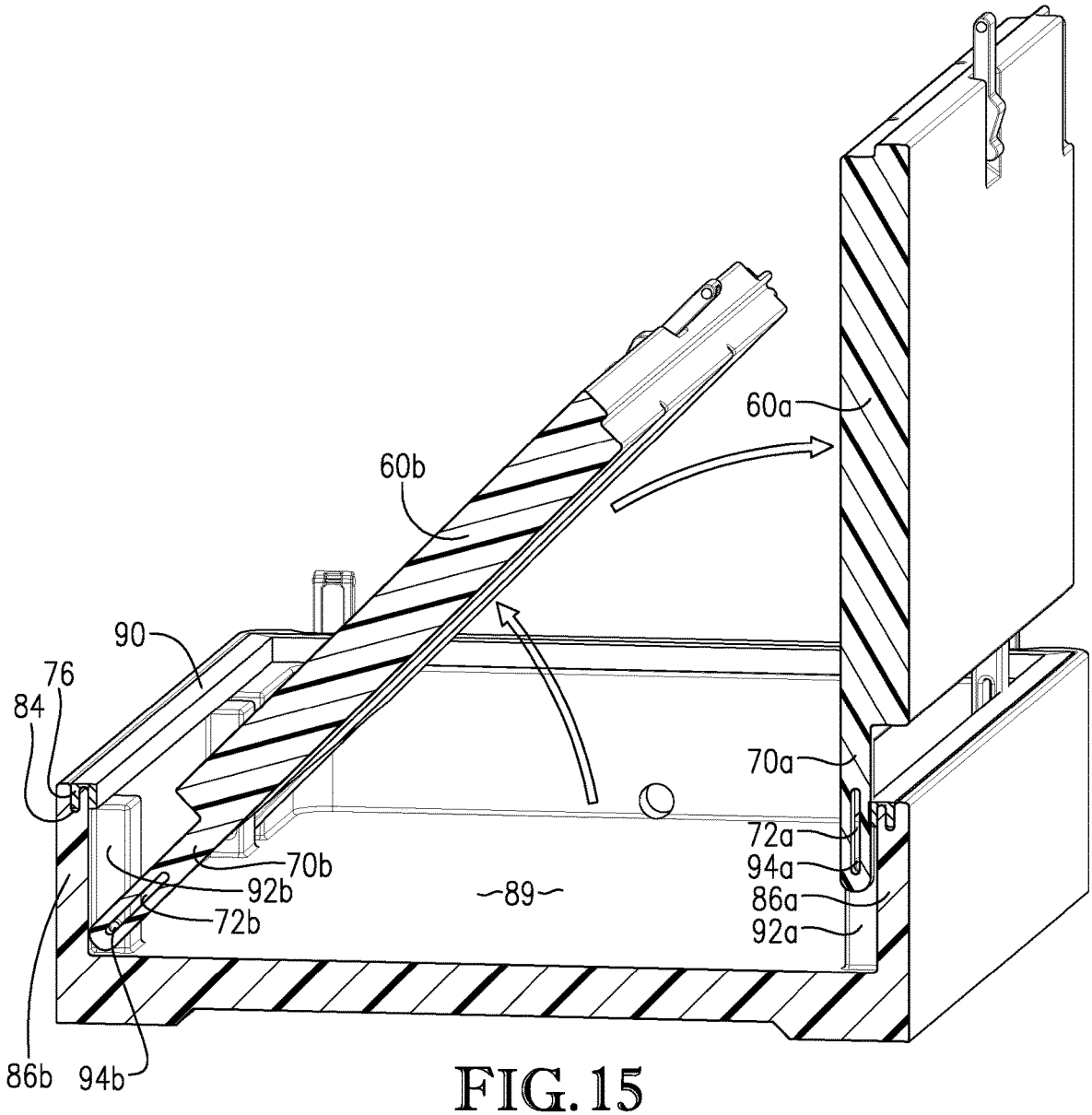
FIG. 15 is a cross-section of the base and side panels of FIG. 13 during assembly of the container from the collapsed configuration to the assembled configuration.
Figure 16:
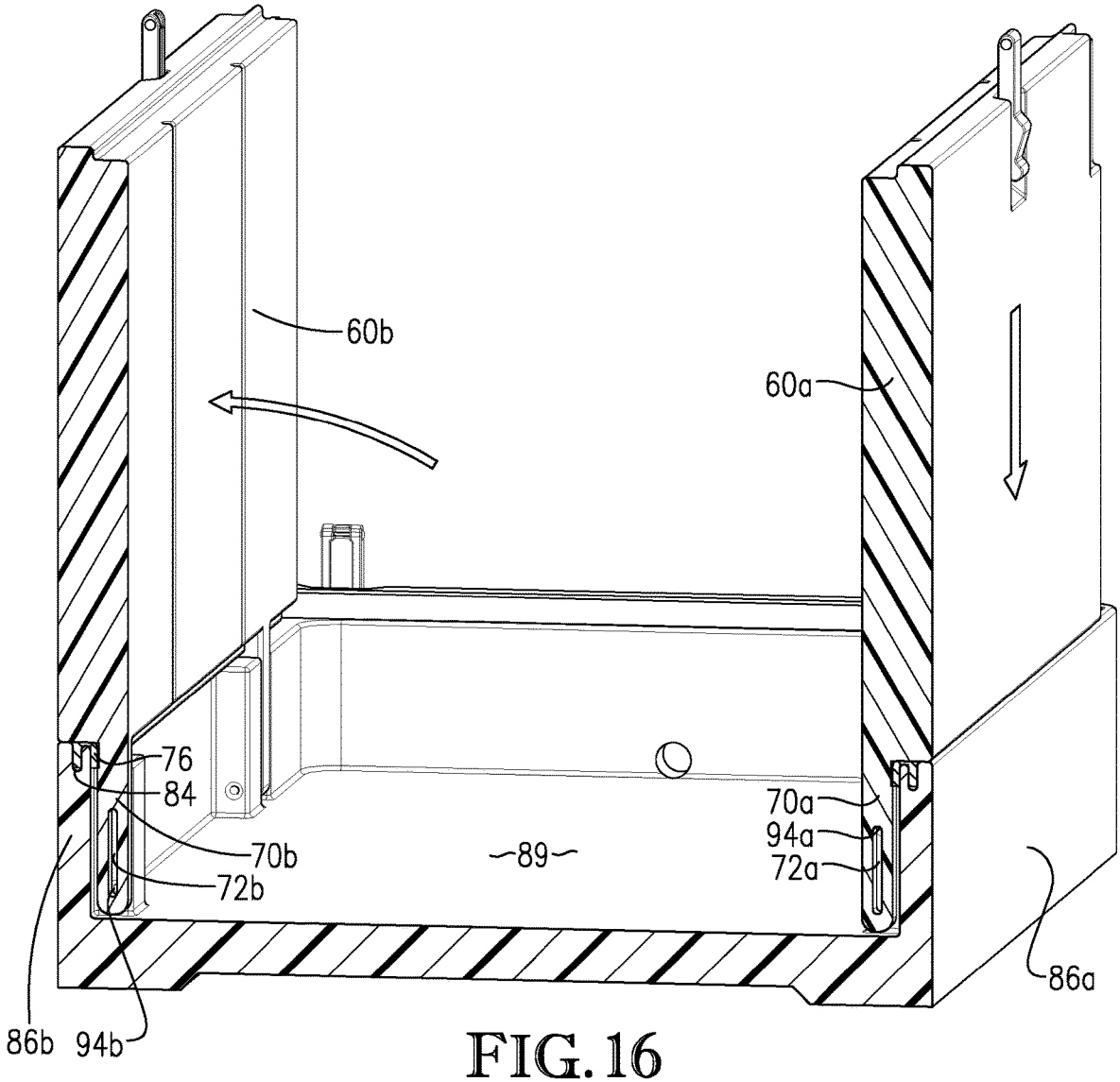
FIG. 16 is a cross-section of the base and side panels of FIG. 13 in the assembled configuration.

Assembly of the side panels is shown in FIGS. 13-16. The fully collapsed side panels 60*a* and 60*b* are shown in FIG. 13. During assembly, first side panel 60*a* is shifted from a horizontal position to an upright position (FIG. 14). This shift occurs by first rotating first side panel 60*a* about first pivot 94*a* via first arm member 70*a* and subsequently sliding first pivot 94*a* along elongated guide 72*a* such that shoulder 74*a* of side panel 60*a* abuts perimeter edge 81 of base 80 (see FIG. 16). Once first side panel 60*a* is in the upright position, second side panel 60*b* is then shifted from a horizontal position to an upright position (FIG. 15). This shift occurs by rotating second side panel 60*b* about second pivot 94*b* via second arm member 70*b* such that shoulder 74*b* of second side panel 60*b* abuts perimeter edge 81 of base 80 opposite of first side panel 60*a*. As can be seen in FIG. 15 and FIG. 16, no or minimal sliding of second arm member 70*b* along elongated guide 72*b* is required to shift second side panel 60*b* from the horizontal to upright position. Similar to end panels 40, in certain embodiments, side panels 60 comprise tongue 76 (shown as a component of seal 90) positioned along shoulder 74*a* and 74*b* adapted to fit in groove 84 of base 80. The tongue and groove fit further secures side panels 60 to base 80. In the assembled configuration, side panels 60 are substantially perpendicular to the interior upper surface 89 of base 80.

Side panels 60 may be secured to end panels 40 by a snap-fit mechanism, although other locking mechanisms may also be used. A seal (e.g., rubber or plastic gasket) (not shown) may be included on adjacent edges of one or both of side panels 60 and end panels 40 to provide a waterproof seal, and preferably air-tight seal, between the mated components at the junction 50 between side panels and end panels. A seal 90 may also be included on one or both of tongue 76 and groove 84 to provide a waterproof seal, and preferably air-tight seal, between side panels 60 and base 80. The use of a seal renders cavity 36 substantially or completely water-impermeable, and preferably air-tight, when container 10 is in the assembled configuration.

Figure 17:
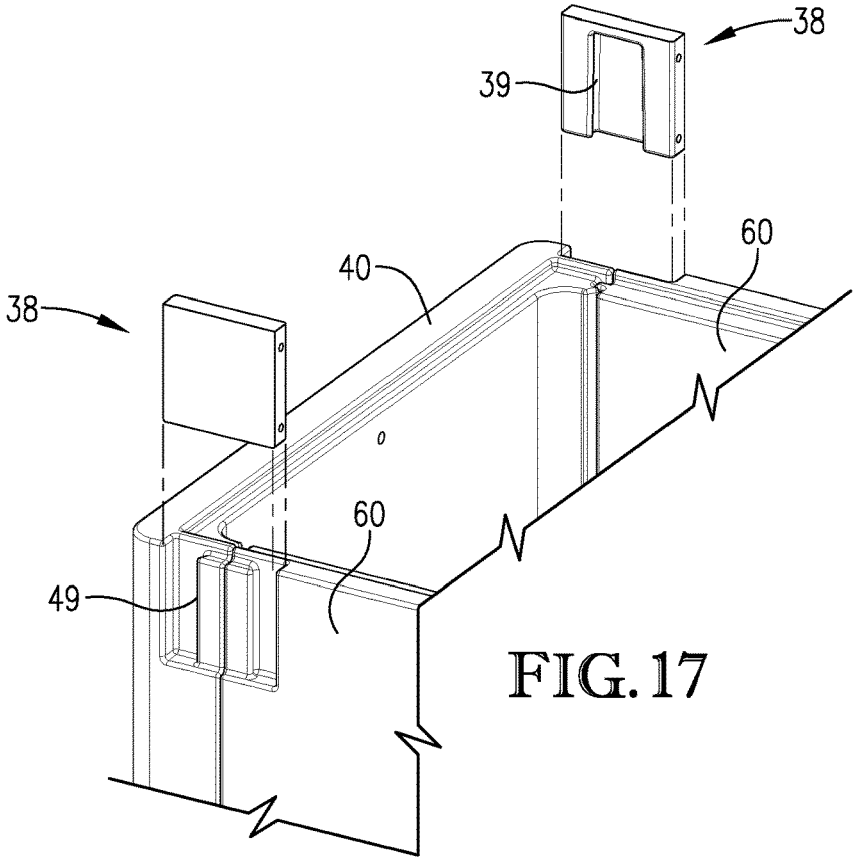
FIG. 17 is a perspective view of a collapsible container during locking block installation in accordance with one embodiment of the present invention.

In certain embodiments, locking blocks 38 are installed to further secure side panels 60 and end panels 40, and to keep tension on the mating joints between panels. In certain embodiments, locking blocks 38 comprise alignment groove 39 adapted to slide onto alignment projections 49 formed on side panels 60 and end panels 40. The alignment groove 39 and alignment projections 49 may be angled or substantially linear. In the embodiment shown in FIG. 17, the angled alignment groove 39 allows for tension to be increased as locking blocks 38 are slid onto angled alignment projections 49. However, in other embodiments, other angled or linear locking mechanisms may be used. For example, in certain embodiments, the locking mechanism can comprise a T-slot connection (e.g., 80/20, Inc. aluminum). Locking blocks 38 may also comprise accessories (e.g., bottle openers, etc.), which can be manufactured into locking block 38 or attached at a later point, for example using post-manufacturing holes, grooves, etc.

Figure 18:
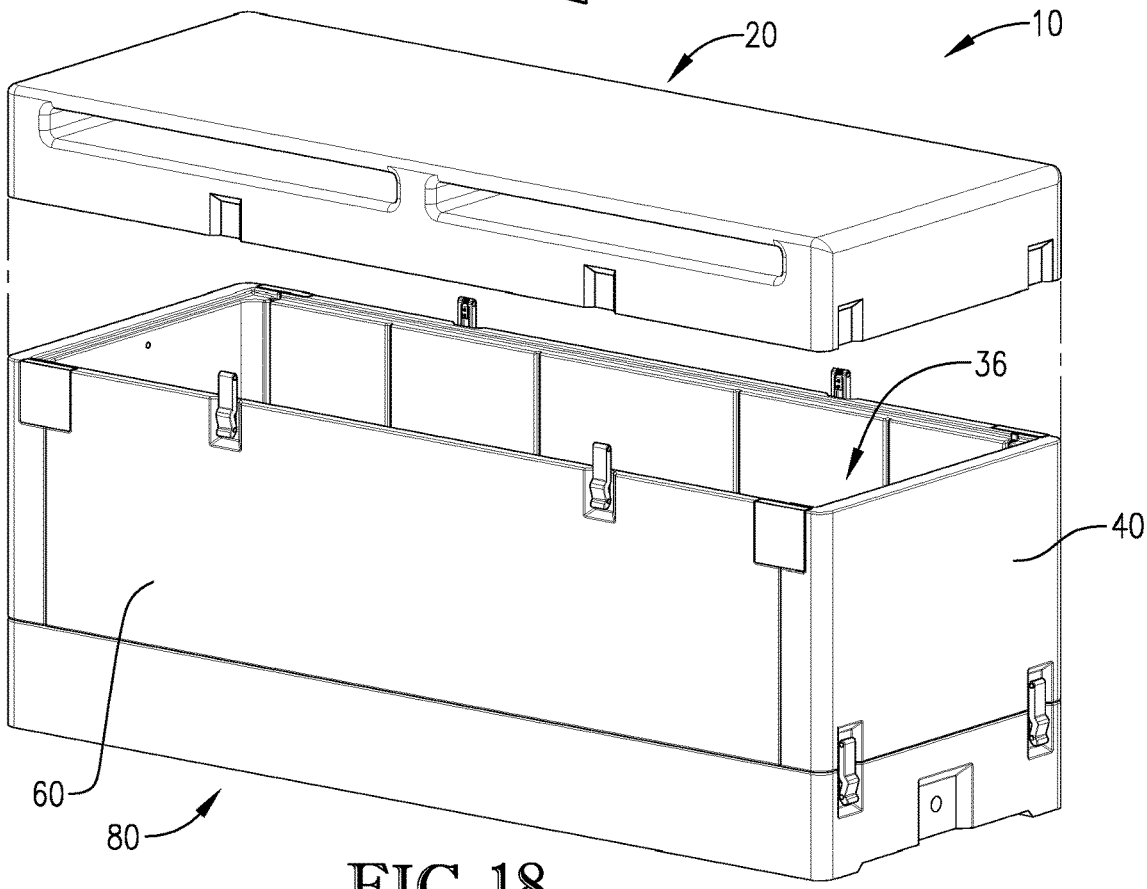
FIG. 18 is a perspective view of a collapsible container in the assembled configuration with the lid removed in accordance with one embodiment of the present invention.
Figure 19:
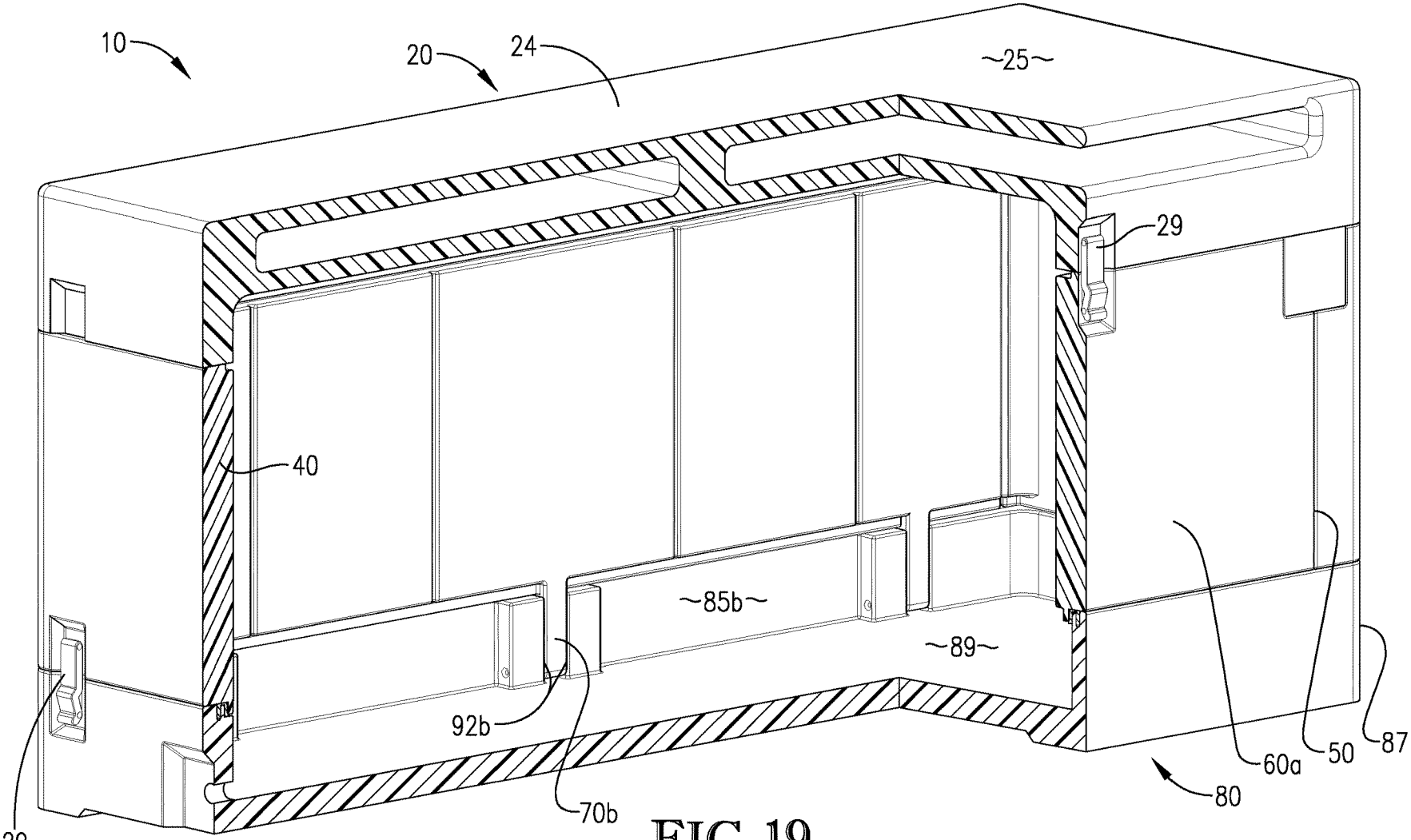
FIG. 19 is a cutaway view of a collapsible container in the assembled configuration in accordance with one embodiment of the present invention.

To complete assembly, lid 20 is placed atop the assembled side panels 60 and end panels 40, such that perimeter edge 21 engages with side panels 60 and end panels 40 to provide an enclosed container 10. Similar to base 80, side panels 60 and/or end panels 40 may comprise one or more fastening mechanisms 29 to secure lid 20 to side panels 60 and end panels 40, and to prevent lid 20 from coming dislodged during movement and storage of container 10. Any of a variety of fastening mechanisms may be used, such as toggle latches, hook latches, hasps, and the like. The type of fastening mechanism and the number of fasteners used can be selected as needed or desired based on the size of the container its specific use. The fastening mechanism may be the same or different than what is used on base 80. A fully assembled container is shown in FIG. 18 (lid off) and FIG. 19 (lid attached).

In certain embodiments, container 10 is a temperature containment vessel, capable of keeping contents stored within cavity 36 either hot or cold. In certain embodiments, container 10 is an ice chest. In certain such embodiments, one or more of lid 20, end panels 40, side panels 60, and/or base 80 are manufactured having a thickness of about 0.5 inch to about 4 inches, preferably about 1 inches to about 3 inches, and more preferably about 1.5 inches to about 2 inches. In certain embodiments, one or more of lid 20, end panels 40, side panels 60, and/or base 80 are manufactured having a thickness of about 2 inches.

These thicknesses are sufficient to deter heat conduction and maintain a desired temperature within cavity 36.

In certain embodiments, the panels and components have advantageous dimensions compared to prior art containers. As described above, the lid, base, end panels, and side panels are separable, which allows for customizations (i.e., designs, initials, etc.) to be manufactured onto or into one or more of the individual components. Such customizations are difficult or impossible with prior art containers and ice chests. For example, laser engraving processes generally have a low acceptable height between the base and laser engraver, where traditional containers and ice chests would be unable to fit. However, in certain preferred embodiments, one or more of the lid, base, end panels, and side panels have an average thickness of less than about 2 inches, preferably less than about 1.5 inches, and more preferably less than about 1 inch. This allows for the separable components to be individually customized, for example by laser engraving. The precise size and thickness of the various panels and components can be chosen for the particular container application.

In certain embodiments, one or more exterior panels other than the lid (e.g., end panels 40 and side panels 60) may comprise one or more passages to provide an additional airgap feature for thermal cooling, similar to passages 30 formed in lid 20. In certain such embodiments, thermal cooling panels may be built into existing panels or offset using standoffs of the original panels.

In certain embodiments, one or more of lid 20, end panels 40, side panels 60, and/or base 80 are made of a plastic material. In certain embodiments, one or more of lid 20, end panels 40, side panels 60, and/or base 80 comprise a plastic selected from the group consisting of polyethylene, polycarbonate, acrylonitrile butadiene styrene, polypropylene, polystyrene, polyurethane, and combinations thereof. In certain such embodiments, these components may comprise a rigid plastic formed on the outer surface with a foam plastic, such as foam polyurethane, which can act as an insulator within the rigid exterior plastic. One or more of lid 20, end panels 40, side panels 60, and/or base 80 are preferably manufactured using a rotational molding (rotomolding) process. However, in certain other embodiments, the components may be manufactured using other techniques, including 3D printing, CNC (computer numerical control) machining, polymer casting, injection molding, vacuum forming, extrusion, blow molding, and the like. The above listed components, as well as other components described herein, may further comprise metals, metal alloys, and rubber or plastic gasketing materials, as necessary depending on the desired strength and weight of the container.

Additional embodiments of the present invention are directed to methods of assembling and/or collapsing the container using the steps and mechanisms described herein. Other embodiments are directed to methods of cooling, heating, or maintaining the temperature of an article. Such methods generally comprise assembling the container from the collapsed configuration to the assembled configuration and placing an article within the container. Exemplary articles include food items, beverages, fish, or game. Additional advantages of the various embodiments of the invention will be apparent to those skilled in the art upon review of the disclosure herein and the working examples below. It will be appreciated that the various embodiments described herein are not necessarily mutually exclusive unless otherwise indicated herein. For example, a feature described or depicted in one embodiment may also be included in other embodiments, but is not necessarily included. Thus, the present invention encompasses a variety of combinations and/or integrations of the specific embodiments described herein.

As used herein, the phrase "and/or," when used in a list of two or more items, means that any one of the listed items can be employed by itself or any combination of two or more of the listed items can be employed. For example, if a composition is described as containing or excluding components A, B, and/or C, the composition can contain or exclude A alone; B alone; C alone; A and B in combination; A and C in combination; B and C in combination; or A, B, and C in combination.

The present description also uses numerical ranges to quantify certain parameters relating to various embodiments of the invention. It should be understood that when numerical ranges are provided, such ranges are to be construed as providing literal support for claim limitations that only recite the lower value of the range as well as claim limitations that only recite the upper value of the range. For example, a disclosed numerical range of about 10 to about 100 provides literal support for a claim reciting "greater than or equal to about 10" (with no upper bounds) and a claim reciting "less than or equal to about 100" (with no lower bounds).

The invention claimed is:

1. A container shiftable between a collapsed configuration and an assembled configuration, the container comprising:

a base comprising an interior upper surface and a barrier wall extending vertically upward from the perimeter of the interior upper surface, the barrier wall comprising at least one first vertical groove formed on a first inward facing surface of the barrier wall and at least one second vertical groove formed on an opposed second inward facing surface of the barrier wall, the at least one first vertical groove comprising a first pivot and the at least one second vertical groove comprising a second pivot, the first pivot being located at a position farther from the interior upper surface of the base than the second pivot;

a first side panel comprising at least one first arm member having an elongated guide formed therein that is rotationally and slidably engaged with the first pivot to allow the first side panel to shift between an upright position when the container is in the assembled configuration and a horizontal position when the container is in the collapsed configuration;

a second side panel comprising at least one second arm member rotationally engaged with the second pivot to allow the second side panel to shift between an upright position when the container is in the assembled configuration and a horizontal position between the interior upper surface of the base and the first side panel when the container is in the collapsed configuration;

a pair of removeable end panels adapted to be positioned upright and engage with the base, the first side panel, and the second side panel to define a container cavity when the container is in the assembled configuration and to be positioned horizontally adjacent the first side panel or the second side panel when the container is in the collapsed configuration; and a removeable lid adapted to engage with the first side panel, the second side panel, and the pair of removeable end panels when the container is in the assembled configuration and to engage with the barrier wall of the base when the container is in the collapsed configuration.

2. The container of claim 1, wherein the interior upper surface and the barrier wall define a base cavity, the first side panel and the second side panel being adapted to reside within the base cavity when the container is in the collapsed configuration.

3. The container of claim 1, wherein the first side panel and the second side panel are identical.

4. The container of claim 1, wherein the pair of removeable end panels comprise two identical panels.

5. The container of claim 1, wherein the first side panel and the second side panel are adapted to remain in continuous contact with the base during shifting of the container between the collapsed configuration and the assembled configuration.

6. The container of claim 1, wherein the at least one second arm member has an elongated guide formed therein that is slidably engaged with the second pivot.

7. The container of claim 1, wherein the first side panel and the second side panel are perpendicular to the interior upper surface of the base when the container is in the assembled configuration.

8. The container of claim 1, wherein the first side panel and the second side panel are parallel to the interior upper surface of the based when the container is in the collapsed configurations.

9. The container of claim 1, further comprising a gasket material positioned between one or more mated edges of the pair of removable end panels, the first side panel, the second side panel, the base, and the removeable lid.

10. The container of claim 1, wherein the removeable lid comprises a top panel and a lid barrier wall extending vertically downward from the perimeter of the top panel.

11. The container of claim 10, wherein the removeable lid comprises at least one passage formed horizontally in the top panel and adapted to allow air to flow therethrough.

12. The container of claim 11, wherein the at least one passage is positioned between an exterior upper surface of the removeable lid and the lid barrier wall.

13. The container of claim 1, wherein the removeable lid, the pair of removeable end walls, the first side panel, the second side panel, and the base comprise a plastic material selected from the group consisting of polycarbonate, acrylonitrile butadiene styrene, polypropylene, polystyrene, polyurethane, and combinations thereof.

14. The container of claim 1, wherein one or more of the removeable lid, the pair of removeable end walls, the first side panel, the second side panel, and the base comprise an insulated plastic material.

15. The container of claim 1, further comprising locking blocks adapted to maintain tension on mating joints between the first side panel, the second side panel, and the pair of removeable end panels when the container is in the assembled configuration.

16. The container of claim 15, wherein the first side panel, the second side panel, and the pair of removeable end panels comprise alignment projections adapted to receive the one or more locking blocks having alignment grooves.

17. A container shiftable between a collapsed configuration and an assembled configuration, the container comprising:

a base comprising an interior upper surface and a barrier wall extending vertically upward from the perimeter of the interior upper surface and defining a base cavity, the barrier wall comprising at least one first vertical groove formed on a first inward facing surface of the barrier wall and at least one second vertical groove formed on an opposed second inward facing surface of the barrier wall, the at least one first vertical groove comprising a first pivot and the at least one second vertical groove comprising a second pivot, the first pivot being located at a position farther from the interior upper surface of the base than the second pivot;

a first side panel comprising at least one first arm member having an elongated guide formed therein that is rotationally and slidably engaged with the first pivot to allow the first side panel to shift between an upright position when the container is in the assembled configuration and a horizontal position when the container is in the collapsed configuration;

a second side panel comprising at least one second arm member having an elongated guide formed therein that is rotationally and slidably engaged with the second pivot to allow the second side panel to shift between an upright position when the container is in the assembled configuration and a horizontal position between the interior upper surface of the base and the first side panel when the container is in the collapsed configuration, wherein the first side panel and the second side panel are of identical construction and adapted to reside within the base cavity when the container is in the collapsed configuration;

a pair of removeable end panels having identical construction adapted to be positioned upright and engage with the base, the first side panel, and the second side panel to define a container cavity when the container is in the assembled configuration and to be positioned horizontally adjacent the first side panel or the second side panel when the container is in the collapsed configuration; and a removeable lid adapted to engage with the first side panel, the second side panel, and the pair of removeable end panels when the container is in the assembled configuration and to engage with the barrier wall of the base when the container is in the collapsed configuration.

18. The container of claim 17, wherein the removeable lid comprises a top panel and a lid barrier wall extending vertically downward from the perimeter of the top panel and at least one passage formed horizontally in the top panel adapted to allow air to flow therethrough.

* * * * *